US007615519B2

(12) United States Patent
Esche, Jr. et al.

(10) Patent No.: US 7,615,519 B2
(45) **Date of Patent: *Nov. 10, 2009**

(54) ADDITIVES AND LUBRICANT FORMULATIONS FOR IMPROVED ANTIWEAR PROPERTIES

(75) Inventors: Carl K. Esche, Jr., Richmond, VA (US); Christopher J. Dudding, Reading (GB); Peter Growcott, Hartley Wintney (GB); Anthony Fagan, Chesterfield, VA (US); Andrew Robertson, Bracknell (GB)

(73) Assignee: Afton Chemical Corporation, Richmond, VA (US)

( * ) Notice: Subject to any disclaimer, the term of this patent is extended or adjusted under 35 U.S.C. 154(b) by 711 days.

This patent is subject to a terminal disclaimer.

(21) Appl. No.: 10/894,327

(22) Filed: Jul. 19, 2004

(65) Prior Publication Data

US 2006/0014651 A1 Jan. 19, 2006

(51) Int. Cl.
*C10M 129/26* (2006.01)
*C10M 125/00* (2006.01)

(52) U.S. Cl. ..... 508/165; 508/179; 123/1 A

(58) Field of Classification Search ..... 508/162, 508/192, 165, 179; 123/1 A
See application file for complete search history.

(56) References Cited

U.S. PATENT DOCUMENTS 2,160,273 A 5/1939 Loane et al.
2,384,577 A 9/1945 Thomas
2,621,195 A 12/1952 Haslam
2,710,872 A 6/1955 Thompson
2,719,125 A 9/1955 Roberts
2,719,126 A 9/1955 Fields et al.
2,786,866 A 9/1957 Hook et al.
2,897,152 A 7/1959 Elliott et al.
2,960,469 A 11/1960 Young
2,995,569 A 8/1961 Hamilton et al.
3,017,361 A * 1/1962 Morris et. al. ..... 508/539
3,087,932 A 4/1963 Lille, Jr.
3,219,666 A 11/1965 Norman et al.
3,277,002 A 10/1966 Hunt et al.
3,356,702 A 12/1967 Farmer et al.
3,399,139 A 8/1968 Forbes et al.
3,407,222 A 10/1968 Lies
3,445,386 A 5/1969 Otto et al.
3,458,548 A 7/1969 Carlson
3,509,051 A 4/1970 Farmer et al.
3,565,804 A 2/1971 Honnen et al.
3,673,090 A 6/1972 Walbillig et al.
3,697,574 A 10/1972 Piasek et al.
3,699,118 A 10/1972 Donham
3,703,504 A 11/1972 Horodysky
3,703,505 A 11/1972 Horodysky et al.
3,736,357 A 5/1973 Piasek et al.
3,758,493 A 9/1973 Maddox, Jr.
3,762,890 A 10/1973 Collins
3,794,081 A 2/1974 Fiser et al.
3,796,661 A 3/1974 Suratwala et al.
3,821,236 A 6/1974 Ripple
3,867,359 A 2/1975 Beadle
3,873,454 A 3/1975 Horodysky et al.
3,904,537 A 9/1975 Ripple
3,969,281 A 7/1976 Sharp
4,029,587 A 6/1977 Koch
4,097,387 A 6/1978 Caspari
4,098,705 A 7/1978 Sakurai et al.
4,107,059 A 8/1978 King et al.
4,122,033 A 10/1978 Black
4,136,043 A 1/1979 Davis
4,164,473 A 8/1979 Coupland et al.
4,171,268 A 10/1979 Collins
4,176,073 A 11/1979 Ryer et al.
4,176,074 A 11/1979 Coupland et al.
4,178,258 A 12/1979 Papay et al.
4,188,299 A 2/1980 Caspari
4,192,757 A 3/1980 Brewster
4,193,882 A 3/1980 Gemmill, Jr.
4,210,683 A 7/1980 Praxl et al.
4,234,435 A 11/1980 Meinhardt et al.
4,248,720 A 2/1981 Coupland et al.
4,259,195 A 3/1981 King et al.
4,261,843 A 4/1981 King et al.
4,263,152 A 4/1981 King et al.
4,265,773 A 5/1981 deVries et al.
4,266,945 A 5/1981 Karn
4,272,387 A 6/1981 King et al.
4,283,295 A 8/1981 De Vries et al.
4,285,822 A 8/1981 De Vries et al.
4,289,635 A 9/1981 Schroeck (Continued)

FOREIGN PATENT DOCUMENTS

EP 330522 12/1994

(Continued)

*Primary Examiner*—Glenn Caldarola
*Assistant Examiner*—Jim Goloboy
(74) *Attorney, Agent, or Firm*—Luedeka, Neely & Graham, PC

(57) ABSTRACT

A lubricated surface and method for reducing wear between metal parts. The lubricated surface contains a base oil of lubricating viscosity and an amount of a hydrocarbon soluble titanium compound effective to provide a reduction in surface wear greater than a surface wear of a lubricant composition devoid of the hydrocarbon soluble titanium compound.

22 Claims, No Drawings

U.S. PATENT DOCUMENTS 4,362,633 A 12/1982 Spence et al.
4,363,322 A 12/1982 Andersson
4,369,119 A 1/1983 De Vries et al.
4,383,931 A 5/1983 Ryu et al.
4,395,343 A 7/1983 De Vries et al.
4,402,840 A 9/1983 De Vries et al.
4,466,901 A 8/1984 Hunt et al.
4,479,883 A 10/1984 Shaub et al.
4,517,114 A 5/1985 Oppenlaender et al.
4,555,352 A 11/1985 Garner et al.
4,636,322 A 1/1987 Nalesnik
4,654,156 A 3/1987 Horodysky et al.
4,692,256 A 9/1987 Umemura et al.
4,702,850 A 10/1987 Gutierrez et al.
4,713,184 A 12/1987 Zaid
4,758,362 A 7/1988 Butke
4,765,918 A 8/1988 Love et al.
4,824,611 A 4/1989 Cells
4,837,190 A 6/1989 Summers, III et al.
4,838,931 A 6/1989 Liebl et al.
4,849,123 A 7/1989 Tipton et al.
4,857,214 A 8/1989 Papay et al.
4,867,890 A 9/1989 Colclough et al.
4,876,375 A 10/1989 Lam
4,885,365 A 12/1989 Lam
4,889,647 A 12/1989 Rowan et al.
4,904,401 A 2/1990 Ripple et al.
4,927,552 A 5/1990 Lam
4,938,880 A 7/1990 Waddoups et al.
4,957,643 A 9/1990 Lam
4,957,649 A 9/1990 Ripple et al.
4,962,256 A 10/1990 Le et al.
4,966,719 A 10/1990 Coyle et al.
4,978,464 A 12/1990 Coyle et al.
4,990,271 A 2/1991 Francis
4,995,996 A 2/1991 Coyle et al.
5,000,863 A 3/1991 Watanabe
5,027,901 A 7/1991 French et al.
5,055,211 A 10/1991 Habeeb et al.
5,110,488 A * 5/1992 Tipton et al. ..... 508/192
5,137,647 A 8/1992 Karol
5,204,012 A 4/1993 Schafthausen
5,242,613 A 9/1993 Ozbalik et al.
5,260,466 A 11/1993 McGibbon
5,286,394 A 2/1994 Moore
5,287,731 A 2/1994 Florkowski et al.
5,292,480 A 3/1994 Fischer et al.
5,322,640 A 6/1994 Byrne et al.
5,328,620 A 7/1994 Ripple
5,387,351 A * 2/1995 Kumar et al. ..... 508/165
5,401,661 A 3/1995 Florkowski et al.
5,412,130 A 5/1995 Karol
5,484,542 A 1/1996 Cahoon et al.
5,486,300 A 1/1996 Salomon et al.
5,490,945 A 2/1996 Smith et al.
5,562,864 A 10/1996 Salomon et al.
5,627,259 A 5/1997 Thaler et al.
5,633,326 A 5/1997 Patil et al.
5,643,859 A 7/1997 Gutierrez et al.
5,652,201 A * 7/1997 Papay et al. ..... 508/228
5,686,397 A 11/1997 Baranski et al.
5,693,598 A 12/1997 Abraham et al.
5,747,430 A 5/1998 Matsushita et al.
5,753,596 A 5/1998 Martin et al.
5,759,485 A 6/1998 Fischer et al.
5,773,391 A 6/1998 Lawate et al.
5,789,357 A 8/1998 Baranski et al.
5,792,729 A 8/1998 Harrison et al.
5,851,965 A 12/1998 Harrison et al.
5,853,434 A 12/1998 Harrison et al.
5,865,884 A * 2/1999 Segawa et al. ..... 106/243
5,902,776 A 5/1999 Dohner et al.
5,936,041 A 8/1999 Diana et al.
5,939,362 A 8/1999 Johnson et al.
6,034,040 A 3/2000 Ozbalik et al.
6,074,444 A 6/2000 Bingley
6,096,691 A 8/2000 Conary et al.
6,103,674 A 8/2000 Nalesnik et al.
6,114,288 A 9/2000 Fujitsu et al.
6,117,826 A 9/2000 Baranski et al.
6,172,012 B1 1/2001 Kumar et al.
6,232,276 B1 5/2001 Stiefel et al.
6,268,316 B1 * 7/2001 Tanaka et al. ..... 508/291
6,300,291 B1 10/2001 Hartley et al.
6,338,819 B1 1/2002 Braga et al.
6,423,670 B2 * 7/2002 Locke et al. ..... 508/192
6,509,303 B1 1/2003 Gatto
6,528,463 B1 3/2003 Gatto et al.
6,583,092 B1 6/2003 Carrick et al.
6,599,472 B1 7/2003 Hudson
6,599,865 B1 7/2003 Esche, Jr. et al.
6,723,685 B2 4/2004 Hartley et al.
6,777,378 B2 8/2004 Abraham et al.
6,797,677 B2 9/2004 Esche, Jr. et al.
6,800,594 B2 10/2004 Miksic et al.
7,122,508 B2 10/2006 Boffa
2002/0119895 A1 * 8/2002 Cook et al. ..... 508/186
2004/0087451 A1 5/2004 Roby et al.
2004/0102335 A1 * 5/2004 Carrick et al. ..... 508/192
2004/0127371 A1 7/2004 Arrowsmith
2004/0200996 A1 10/2004 Meyer
2004/0204325 A1 10/2004 Takahashi
2004/0242433 A1 12/2004 Roby et al.
2004/0266630 A1 12/2004 George et al.

FOREIGN PATENT DOCUMENTS

EP 874040 10/1998
EP 0995790 4/2000
GB 885679 12/1961
GB 997335 7/1965
GB 1560830 2/1980
GB 866054 4/1991
JP 61-111397 5/1986
JP 62236894 10/1987
JP 03-190997 A 8/1991
JP 10-259392 A 9/1998
JP 11-131084 A 5/1999
JP 2002-302691 10/2002
JP 2004149762 5/2004
JP 2004-182829 A 7/2004
SU 1669976 A1 8/1991
SU 1689975 A1 8/1991
WO WO 9811181 3/1998
WO WO 02092734 11/2002

* cited by examiner

ADDITIVES AND LUBRICANT FORMULATIONS FOR IMPROVED ANTIWEAR PROPERTIES

TECHNICAL FIELD

The embodiments described herein relate to particular oil soluble metal additives and use of such metal additives in lubricating oil formulations to improve antiwear properties of the formulations.

BACKGROUND

The next generation of passenger car motor oil and heavy duty diesel engine oil categories will require equivalent antiwear properties but with lower levels of phosphorus and sulfur in the formulations in order to reduce contamination of more stringent pollution control devices. It is well known that sulfur and phosphorus containing additives impart antiwear properties to a finished oil, and also may poison or otherwise reduce the effectiveness of pollution control devices.

Zinc dialkyl dithiophosphates ("Zn DDPs") have been used in lubricating oils for many years. Zn DDPs also have good antiwear properties and have been used to pass cam wear tests, such as the Seq IVA and TU3 Wear Test. Many patents address the manufacture and use of Zn DDPs including U.S. Pat. Nos. 4,904,401; 4,957,649; 6,114,288, all of which are incorporated herein by reference in their entirety.

Sulfur-containing antiwear are also well known and include dihydrocarbyl polysulfides; sulfurized olefins; sulfurized fatty acid esters of both natural and synthetic origins; trithiones; sulfurized thienyl derivatives; sulfurized terpenes; sulfurized polyenes; sulfurized Diels-Alder adducts, etc. Specific examples include sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfides such as mixtures of di-tert-butyl trisulfide, di-tert-butyl tetrasulfide and di-tert-butyl pentasulfide, among others. Of the foregoing, sulfurized olefins are used in many applications. Methods of preparing sulfurized olefins are described in U.S. Pat. Nos. 2,995,569; 3,673,090; 3,703,504; 3,703,505; 3,796,661; and 3,873,454. Also useful are the sulfurized olefin derivatives described in U.S. Pat. No. 4,654,156. Other sulfur-containing antiwear agents are described in U.S. Pat. Nos. 4,857,214, 5,242,613, and 6,096,691.

A need exists for a lubricating additive that provides excellent antiwear properties and is more compatible with pollution control devices used for automotive and diesel engines.

SUMMARY OF THE EMBODIMENTS

In one embodiment herein is presented a lubricated surface exhibiting reduce wear. The lubricated surface includes an antiwear coating of a lubricant composition containing a base oil of lubricating viscosity and an amount of a hydrocarbon soluble titanium compound effective to provide a reduction in surface wear greater than a surface wear of a lubricant composition devoid of the hydrocarbon soluble titanium compound.

In another embodiment, there is provided a vehicle having moving parts and containing a lubricant for lubricating the moving parts. The lubricant includes an oil of lubricating viscosity and an amount of antiwear agent providing from about 50 to about 500 parts per million titanium in the form of a hydrocarbon soluble titanium compound.

In yet another embodiment there is provided a fully formulated lubricant composition. The lubricant composition includes a base oil component of lubricating viscosity, an amount of hydrocarbon soluble titanium-containing agent providing from about 50 to about 500 parts per million of a titanium metal which is sufficient to reduce an amount of phosphorus or sulfur antiwear agent in the lubricant composition for substantially equivalent wear performance in the absence of the titanium-containing agent.

A further embodiment of the disclosure provides a method of lubricating moving parts with a lubricating oil exhibiting increased antiwear properties. The method includes using as the lubricating oil for one or more moving parts a lubricant composition containing a base oil and an antiwear additive. The antiwear additive contains a hydrocarbyl fluid and an amount of hydrocarbon soluble titanium compound providing from about 50 to about 500 parts per million titanium in the lubricating oil.

As set forth briefly above, embodiments of the disclosure provide an antiwear additive including a hydrocarbon soluble titanium compound that may significantly improve the antiwear performance of a lubricant composition thereby enabling a decrease in the amount of phosphorus and sulfur antiwear additives required for equivalent antiwear performance. The additive may be mixed with an oleaginous fluid that is applied to a surface to reduce surface wear. In other applications, the additive may be provided in a fully formulated lubricant composition. The additive is particularly directed to meeting the currently proposed GF-4 standards for passenger car motor oils and PC-10 standards for heavy duty diesel engine oil.

The compositions and methods described herein are particularly suitable for reducing contamination of pollution control devices on motor vehicles or, in the alternative, the compositions are suitable for improving the performance of antiwear agents in lubricant formulations. Other features and advantages of the compositions and methods described herein may be evident by reference to the following detailed description which is intended to exemplify aspects of the preferred embodiments without intending to limit the embodiments described herein.

It is to be understood that both the foregoing general description and the following detailed description are exemplary and explanatory only and are intended to provide further explanation of the embodiments disclosed and claimed.

DETAILED DESCRIPTION OF EMBODIMENTS

In one embodiment is presented a novel composition useful as a component in lubricating oil compositions. The composition comprises a hydrocarbon soluble titanium compound that may be used in addition to or as a partial replacement for conventional antiwear additives containing phosphorus and sulfur.

The primary component of the additives and concentrates provided for lubricant compositions is a hydrocarbon soluble titanium compound. The term "hydrocarbon soluble" means that the compound is substantially suspended or dissolved in a hydrocarbon material, as by reaction or complexation of a reactive titanium compound with a hydrocarbon material. As used herein, "hydrocarbon" means any of a vast number of compounds containing carbon, hydrogen, and/or oxygen in various combinations.

Examples of suitable titanium compounds for use according to the disclosure, include, but are not limited to, titanium compounds derived from acids, alcohols, and glycols, such as titanium carboxylates, titanium phenates, titanium alkoxides, titanium sulfonates, and the like. Such compounds may contain from about 5 to about 200 or more carbon atoms in a hydrocarbyl component of the compound.

The term "hydrocarbyl" refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Examples of useful titanium alkoxides include, but are not limited to, $C_1$-$C_{20}$ alkyl titanates, such as octylene glycol titanate, butyl titanate, polybutyl titanate, tetra-isopropyl titanate, tetranonyl titanate, and tetra iso-octyl titanate. Aryl and aralkyl esters of titanium may also be used such as tetraphenyl titanates, tetrabenzyl titanates, diethyl diphenyl titanates, and the like. Examples of suitable titanates may be found in U.S. Pat. Nos. 2,160,273; 2,960,469; and 6,074,444.

Titanium salts of carboxylic acids may be made by reacting the alkali metal salt aqueous solution of an organic acid, the amine salt aqueous solution of the organic acid, and/or the ammonium salt aqueous solution of the organic acid with the aqueous solution of titanium tetrachloride and subsequently oxidizing the reaction product. Examples of titanium salts of carboxylic acids include, but are not limited to, titanium salts of formic, acetic, proprionic, buyric, valeric, caproic, caprylic, lauric, myristic, palmitic, stearic, oleic, linoleic, linolenic, cyclohexanecarboxylic, phenylacetic, benzoic, neodecanoic acids, and the like.

Other titanium organic compounds that may be used include, but are not limited to titanium phenates, titanium salicylates, titanium phosphates, and sulphurized titanium phenates, wherein each aromatic group has one or more aliphatic groups to impart hydrocarbon solubility; the basic salts of any of the foregoing phenols or sulphurized phenols (often referred to as "overbased" phenates or "overbased sulphurized phenates"); and titanium sulfonates wherein each sulphonic acid moiety is attached to an aromatic nucleus which in turn usually contains one or more aliphatic substituents to impart hydrocarbon solubility; the highly basic salts of any of the foregoing sulfonates (often referred to as "overbased sulfonates". The sulfonates, salicylates, phosphates, and phenates described above may include sodium, potassium, calcium, and/or magnesium sulfonates and phenates in combination with the titanium sulfonates, salicylates, phosphates, and phenates.

The hydrocarbon soluble titanium compounds of the embodiments described herein are advantageously incorporated into lubricating compositions. The titanium compounds may be added directly to the lubricating oil composition. In one embodiment, however, they are diluted with a substantially inert, normally liquid organic diluent such as mineral oil, synthetic oil (e.g., ester of dicarboxylic acid), naptha, alkylated (e.g., C10-C13 alkyl) benzene, toluene or xylene to form an additive concentrate. The titanium additive concentrates usually contain from about 0% to about 99% by weight diluent oil.

In the preparation of lubricating oil formulations it is common practice to introduce the additives in the form of 1 to 99 wt. % active ingredient concentrates in hydrocarbon oil, e.g. mineral lubricating oil, or other suitable solvent. Usually these concentrates may be added with 0.05 to 10 parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Lubricant compositions made with the hydrocarbon soluble titanium additive described above are used in a wide variety of applications. For compression ignition engines and spark ignition engines, it is preferred that the lubricant compositions meet or exceed published GF-4 or API-CI-4 standards. Lubricant compositions according to the foregoing GF-4 or API-CI-4 standards include a base oil and an oil additive package to provide a fully formulated lubricant. The base oil for lubricants according to the disclosure is an oil of lubricating viscosity selected from natural lubricating oils, synthetic lubricating oils and mixtures thereof. Such base oils include those conventionally employed as crankcase lubricating oils for spark-ignited and compression-ignited internal combustion engines, such as automobile and truck engines, marine and railroad diesel engines, and the like.

Natural oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The synthetic lubricating oils used in this invention include one of any number of commonly used synthetic hydrocarbon oils, which include, but are not limited to, poly-alpha-olefins, alkylated aromatics, alkylene oxide polymers, interpolymers, copolymers and derivatives thereof here the terminal hydroxyl groups have been modified by esterification, etherification etc, esters of dicarboxylic acids and silicon-based oils.

Fully formulated lubricants conventionally contain an additive package, referred to herein as a dispersant/inhibitor package or DI package, that will supply the characteristics that are required in the formulations. Suitable DI packages are described for example in U.S. Pat. Nos. 5,204,012 and 6,034,040 for example. Among the types of additives included in the additive package are detergents, dispersants, friction modifiers, seal swell agents, antioxidants, foam inhibitors, lubricity agents, rust inhibitors, corrosion inhibitors, demulsifiers, viscosity index improvers, and the like. Several of these components are well known to those skilled in the art and are preferably used in conventional amounts with the additives and compositions described herein.

For example, ashless dispersants include an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorus esters, metal thiocarbamates and oil soluble copper compounds as described in U.S. Pat. No. 4,867,890.

Rust inhibitors selected from the group consisting of nonionic polyoxyalkylene polyols and esters thereof, polyoxyalkylene phenols, and anionic alkyl sulfonic acids may be used.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Seal swell agents, as described, for example, in U.S. Pat. Nos. 3,794,081 and 4,029,587, may also be used.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The titanium compound additives may be added directly to the lubricating oil composition. In one embodiment, however, they are diluted with a substantially inert, normally liquid organic diluent such as mineral oil, synthetic oil, naphtha, alkylated (e.g. C10-C13 alkyl) benzene, toluene or xylene to form an additive concentrate. These concentrates usually contain from about 1% to about 100% by weight and in one embodiment about 10% to about 90% by weight of the titanium compound.

Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, and polysilicone oils. Natural base oils include mineral lubrication oils which may vary widely as to their crude source, e.g., as to whether they are paraffinic, naphthenic, or mixed paraffinic-naphthenic. The base oil typically has a viscosity of about 2.5 to about 15 cSt and preferably about 2.5 to about 11 cSt at 110° C.

Accordingly, the base oil used which may be used may be selected from any of the base oils in Groups I-V as specified in the American Petroleum Institute (API) Base Oil Interchangeability Guidelines. Such base oil groups are as follows:

| Base Oil Group[1] | Sulfur (wt. %) | | Saturates (wt. %) | Viscosity Index |
|---|---|---|---|---|
| Group I | >0.03 | and/or | <90 | 80 to 120 |
| Group II | <0.03 | And | >90 | 80 to 120 |
| Group III | <0.03 | And | >90 | >120 |
| Group IV | all polyalphaolefins (PAOs) | | | |
| Group V | all others not included in Groups I-IV | | | |

[1]Groups I-III are mineral oil base stocks.

The additives used in formulating the compositions described herein can be blended into the base oil individually or in various sub-combinations. However, it is preferable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

The embodiments provide a lubricating oil for internal combustion engines in which the concentration of the added hydrocarbon soluble titanium compound is relatively low, providing from about 50 to about 500 parts per million (ppm) titanium in terms of elemental titanium in the oil. In one embodiment, the titanium compound is present in the lubricating oil compositions in an amount sufficient to provide from about 100 to about 200 ppm titanium metal, and in a further embodiment from about 120 to about 180 ppm titanium metal.

The following example is given for the purpose of exemplifying aspects of the embodiments and is not intended to limit the embodiments in any way.

EXAMPLE

Thirteen fully formulated lubricant compositions were made and the wear properties of the compositions were compared using a four ball wear test according to European test code IP-239. Each of the lubricant compositions contained a conventional DI package providing 11 percent by weight of the lubricant composition. The DI package contained conventional amounts of detergents, dispersants, antiwear additives, friction modifiers, antifoam agents, and antioxidants. The formulations also contained about 0.1 percent by weight pour point depressant, about 11.5 percent by weight olefin copolymer viscosity index improver, about 62 to 63 percent by weight 150 solvent neutral oil, about 14.5 percent by weight 600 solvent neutral oil. Sample 1 contained no titanium compound. Samples 2-13 contained titanium compounds in amounts sufficient to provide about 80 to about 200 ppm titanium metal. The samples was tested in the lubricant formulation using a four ball wear test at room temperature, for 60 minutes at an rpm of 1475 using a 40 kilogram weight. The formulations and results are given in the following table.

| Component | Sample 1 | Sample 2 | Sample 3 | Sample 4 | Sample 5 | Sample 6 | Sample 7 | Sample 8 | Sample 9 | Sample 10 | Sample 11 | Sample 12 | Sample 13 |
|---|---|---|---|---|---|---|---|---|---|---|---|---|---|
| DI Package | 11.0 | 11.0 | 11.0 | 11.0 | 11.0 | 11.0 | 11.0 | 11.0 | 11.0 | 11.0 | 11.0 | 11.0 | 11.0 |
| Ti-TEN CEN | — | 0.170 | 0.340 | — | — | — | — | — | — | — | — | — | — |
| Ti-2-EHO | — | — | — | 0.115 | 0.230 | — | — | — | — | — | — | — | — |
| KR-TTS | — | — | — | — | — | 0.183 | 0.336 | — | — | — | — | — | — |
| LICA-01 | — | — | — | — | — | — | — | 0.173 | 0.346 | — | — | — | — |
| KR-12 | — | — | — | — | — | — | — | — | — | 0.327 | 0.654 | — | — |
| KR-9S | — | — | — | — | — | — | — | — | — | — | — | 0.287 | 0.575 |
| PPD | 0.100 | 0.100 | 0.100 | 0.100 | 0.100 | 0.100 | 0.100 | 0.100 | 0.100 | 0.100 | 0.100 | 0.100 | 0.100 |
| Viscosity index improver | 11.5 | 11.5 | 11.5 | 11.5 | 11.5 | 11.5 | 11.5 | 11.5 | 11.5 | 11.5 | 11.5 | 11.5 | 11.5 |
| ESSO 150 solvent neutral oil | 62.90 | 62.73 | 62.56 | 62.78 | 62.67 | 62.72 | 62.53 | 62.73 | 62.55 | 62.57 | 62.25 | 62.61 | 62.32 |
| ESSO 600 solvent neutral oil | 14.50 | 14.50 | 14.50 | 14.50 | 14.50 | 14.50 | 14.50 | 14.50 | 14.50 | 14.50 | 14.50 | 14.50 | 14.50 |
| Total | 100 | 100 | 100 | 100 | 100 | 100 | 100 | 100 | 100 | 100 | 100 | 100 | 100 |
| Ti (ppm) | 0 | 87 | 167 | 100 | 196 | 91 | 176 | 105 | 205 | 101 | 198 | 102 | 202 |
| 4 ball wear test | 0.65 | 0.42 | 0.46 | 0.47 | 0.46 | 0.37 | 0.44 | 0.34 | 0.40 | 0.44 | 0.42 | 0.48 | 0.37 |

In the above table, the following legend is used:
T-CEN is a titanium neodecanoate from OM Group, Inc. of Newark, New Jersey and contains about 6.7% by weight titanium metal.
Ti-2-EHO is titanium 2-ethylhexoxide containing about 8.7% by weight titanium metal.
KR-TTS is titanium IV 2-propanolato, tris isooctadecanoate-O from Kenrich Petrochemicals, Inc. of Bayonne, New Jersey and contains about 5.5% titanium metal.
LICA-01 is titanium IV 2,2(bis 2-proenolatomethyl)butanolato, tris neodecanoate-O from Kenrich Petrochemicals, Inc. and contains about 5.8% titanium metal.
KR-12 is titanuim IV 2-propanolato, tris(dioctyl)phosphato-O, from Kenrich Petrochemicals, Inc. and contains about 3.1% titanium metal.
KR-9S is titanium IV 2-propanolato, tris(dodecyl)benzenesulfanato-O, from Kenrich Petrochemicals, Inc. and contains about 3.5% titanium metal.
PPD is a pour point depressant from Afton Chemical Corporation of Richmond Virginia, under the trade name HiTEC ® 672.

As illustrated by the foregoing results, samples 2-13 containing from about 80 to about 200 ppm titanium metal in the form of a hydrocarbon soluble titanium compound significantly outperformed a conventional lubricant composition containing no titanium metal. Sample 1 containing no titanium metal had a wear scar diameter of about 0.65 millimeters whereas the other samples containing titanium had wear scar diameters ranging from about 0.35 to about 0.47 millimeters. It is expected that formulations containing from about 50 to about 500 ppm titanium metal in the form of a hydrocarbon soluble titanium compound will enable a reduction in conventional phosphorus and sulfur antiwear agents thereby improving the performance of pollution control equipment on vehicles while achieving a similar antiwear performance or benefit.

At numerous places throughout this specification, reference has been made to a number of U.S. patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. An internal combustion engine lubricant composition comprising a base oil of lubricating viscosity and an amount of a hydrocarbon soluble titanium compound effective to provide a reduction in surface wear greater than a surface wear of a lubricant composition devoid of the hydrocarbon soluble titanium compound, wherein the titanium compound comprises a titanium salt of a non-linear carboxylic acid and wherein the lubricant composition contains from about 50 to about 500 ppm titanium metal and is formulated to meet at least GF-4 standards for passenger car motor oils and at least PC-10 standards for heavy duty diesel engine oils.

2. The lubricant composition of claim 1, wherein the internal combustion engine comprises a spark ignition engine.

3. The lubricant composition of claim 1, wherein the internal combustion engine comprises a compression ignition engine.

4. The lubricant composition of claim 1, wherein the hydrocarbon soluble titanium compound comprises a titanium salt of neodecanoic acid.

5. A motor vehicle comprising the lubricant composition of claim 1.

6. The lubricant composition of claim 1, wherein the internal combustion engine comprises a heavy duty diesel engine.

7. A fully formulated lubricant composition for an internal combustion engine comprising a base oil component of lubricating viscosity, an amount of hydrocarbon soluble titanium-containing agent effective to provide a reduction in an amount of phosphorus or sulfur antiwear agent needed in the lubricant composition to provide substantially equivalent wear performance in the absence of the titanium-containing agent, wherein the titanium-containing agent comprises a titanium salt of a non-linear carboxylic acid and wherein the lubricant composition contains from about 50 to about 500 ppm titanium metal and as formulated meets at least GF-4 standards for passenger car motor oils and at least PC-10 standards for heavy duty diesel engine oils.

8. The lubricant composition of claim 7 wherein the lubricant composition comprises a low ash, low sulfur, and low phosphorus lubricant composition suitable for compression ignition engines.

9. The lubricant composition of claim 7, wherein the hydrocarbon soluble titanium-containing agent comprises a titanium salt of neodecanoic acid.

10. A method of reducing wear of metal parts in an internal combustion engine comprising contacting the engine parts with a lubricant composition comprising a base oil component of lubricating viscosity and from about 50 to about 500 parts per million titanium in the form of a hydrocarbon soluble titanium compound, wherein the titanium compound comprises a titanium salt of a non-linear carboxylic acid and wherein the lubricant composition is formulated to meet at least GF-4 standards for passenger car motor oils and at least PC-10 standards for heavy duty diesel engine oils.

11. The method of claim 10, wherein the internal combustion engine comprises a heavy duty diesel engine.

12. The method of claim 10, wherein the hydrocarbon soluble titanium compound comprises a titanium salt of neodecanoic acid.

13. A lubricant additive concentrate for providing improved antiwear properties to a lubricant composition for an internal combustion engine comprising the concentrate and a hydrocarbyl carrier fluid, the concentrate comprising an amount of a hydrocarbon soluble titanium compound sufficient to provide an antiwear performance for the lubricant composition greater than an antiwear performance of a lubricant composition devoid of the hydrocarbon soluble titanium compound, wherein the titanium compound comprises a titanium salt of a non-linear carboxylic acid and wherein the lubricant composition containing the concentrate is formulated to contain from about 50 to about 500 ppm titanium metal and is formulated to meet at least GF-4 standards for passenger car motor oils and at least PC-10 standards for heavy duty diesel engine oils.

14. The additive concentrate of claim 13, wherein the hydrocarbon soluble titanium compound comprises a titanium salt of neodecanoic acid.

15. A lubricant composition for an internal combustion engine comprising a base oil and the additive concentrate of claim 13.

16. A method of lubricating moving parts of an internal combustion engine with a lubricating oil exhibiting increased antiwear properties, the method comprising using as the lubricating oil for one or more moving parts of the engine a lubricant composition containing a base oil and an antiwear additive, the antiwear additive comprising a hydrocarbyl carrier fluid and an amount of hydrocarbon soluble titanium compound providing from about 50 to about 500 parts per million titanium in the lubricating oil, wherein the titanium compound comprises a titanium salt of a non-linear carboxylic acid and wherein the lubricant composition is formulated to meet at least meet GF-4 standards for passenger car motor oils and at least PC-10 standards for heavy duty diesel engine oils.

17. The method of claim 16, wherein the engine is selected from the group consisting of a compression ignition engine and a spark ignition engine.

18. The method of claim 16, wherein the internal combustion engine has a crankcase and wherein the lubricating oil comprises a crankcase oil present in the crankcase of the engine.

19. The method of claim 16, wherein the hydrocarbon soluble titanium compound comprises a titanium salt of neodecanoic acid.

20. A metal surface of an internal combustion engine comprising a wear reducing amount of an oleaginous composition containing an amount of titanium provided by a hydrocarbon soluble titanium compound sufficient to reduce metal surface wear to less than an amount of metal surface wear in the absence of titanium, wherein the titanium compound comprises a titanium salt of a non-linear carboxylic acid and wherein the oleaginous composition is formulated to contain from about 50 to about 500 ppm titanium metal and is formulated to meet at least GF-4 standards for passenger car motor oils and at least PC-10 standards for heavy duty diesel engine oils.

21. The metal surface of claim 20, wherein the hydrocarbon soluble titanium compound comprises a titanium salt of neodecanoic acid.

22. The metal surface of claim 20, further comprising an amount of phosphorus and sulfur antiwear agents which is less than an amount of phosphorus and sulfur antiwear agents for substantially equivalent wear performance in the absence of the hydrocarbon soluble titanium compound.

* * * * *

UNITED STATES PATENT AND TRADEMARK OFFICE

CERTIFICATE OF CORRECTION

PATENT NO. : 7,615,519 B2
APPLICATION NO. : 10/894327
DATED : November 10, 2009
INVENTOR(S) : Esche, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 960 days.

Signed and Sealed this

Nineteenth Day of October, 2010

David J. Kappos

David J. Kappos
*Director of the United States Patent and Trademark Office*